US005974770A

United States Patent [19]

Kume et al.

[11] Patent Number: 5,974,770

[45] Date of Patent: Nov. 2, 1999

[54] PRESS IN A FILLING AND PACKAGING APPARATUS

[75] Inventors: Satoshi Kume; Hiroshi Katayama; Shigenori Tawa; Michio Ueda, all of Tokushima-ken, Japan

[73] Assignee: Shikoku Kakoki Co., Ltd., Tokushima, Japan

[21] Appl. No.: 08/966,219

[22] Filed: Nov. 7, 1997

[30] Foreign Application Priority Data

Nov. 26, 1996 [JP] Japan ..... 8-314650

[51] Int. Cl.[6] ..... B65B 9/06

[52] U.S. Cl. ..... 53/550; 53/373.2; 53/373.4

[58] Field of Search ..... 53/550, 551, 450, 53/451, 552, 553, 373.2, 373.4, 373.7

[56] References Cited

U.S. PATENT DOCUMENTS

| | | | |
|---|---|---|---|
| 4,384,438 | 5/1983 | Hilmersson | 53/552 |
| 4,580,392 | 4/1986 | Lagerstedt et al. | 53/552 |
| 4,757,668 | 7/1988 | Klinkel et al. | 53/551 |
| 5,027,579 | 7/1991 | Keip | 53/133.3 |
| 5,540,035 | 7/1996 | Plahm et al. | 53/551 |

FOREIGN PATENT DOCUMENTS

| | | | |
|---|---|---|---|
| 091712 | 4/1983 | European Pat. Off. . | |
| 228362 | 4/1983 | European Pat. Off. . | |
| 140280 | 10/1984 | European Pat. Off. . | |
| 265021 | 10/1985 | European Pat. Off. . | |
| 2751088 | 5/1979 | Germany | 53/552 |
| 58-193206 | 11/1983 | Japan . | |
| 1-23366 | 5/1989 | Japan . | |
| 8-244707 | 8/1997 | Japan . | |
| 1140057 | 4/1966 | United Kingdom . | |

OTHER PUBLICATIONS

Copy of European Search Report 97119809 completed Mar.19, 1998.

*Primary Examiner*—James F. Coan
*Assistant Examiner*—Gene L. Kim
*Attorney, Agent, or Firm*—Smith, Gambrell & Russell, LLP; Beveridge, DeGrandi, Weilacher & Young; Intellectual Property Group

[57] ABSTRACT

There is provided a press capable of solving a new problem of breakage of springs and surely applying the pressure for a long period of time in the lateral sealing process in a high-speed filling and packaging apparatus for manufacturing package containers each having a rectangular shape in cross section and filled with a fluid content such as juice. In the press comprising seal bars and a pair of engaging members which are respectively provided at both ends of the seal bars for producing a sealing pressure when they engage with each other for permitting said seal bars to nip a packaging material web which is filled with a fluid content and formed in a tubular shape, the press employs fluid such as air as a means for advancing a piston rod to which the movable engaging member is secured and a pressure sensor is provided for detecting the change of pressure of fluid in an air supply passage.

6 Claims, 5 Drawing Sheets

PRESS IN A FILLING AND PACKAGING APPARATUS

BACKGROUND OF THE INVENTION

1. Field of the Invention

The present invention relates to a press for use in a lateral sealing process in a high-speed filling and packaging apparatus for manufacturing package containers each having a rectangular shape in cross section and filled with a fluid such as juice, particularly to a press provided with a hydraulic cylinder.

2. Prior Art

There is known a conventional filling and packaging apparatus comprising a rewinder for supporting a web serving as a packaging material (hereinafter referred to simply as packaging material web) in a rolled state, a winding apparatus for winding the web in order from the rewinder, a tube-forming apparatus for forming the wound web in a tubular shape after sterilizing it, a fluid supply pipe for filling fluid in the packaging material web which was formed in the tubular shape, and a container-forming apparatus for laterally sealing the web and cutting sealed parts of the web to continuously form pillow-like containers each having a rectangular shape in cross section while downwardly supplying the tube filled with the fluid by the length corresponding to one container, and a container shaping apparatus for bending each end part of the pillow-like containers which are separated into individual ones to shape each pillow-like container in a parallelepiped container to be finally obtained (as disclosed in JP-B 1-23366 and JP-A 58-193206)).

The aforementioned container-forming apparatus nips a tube filled with a fluid content by a length corresponding to one container and seals it laterally, and cuts the intermediate portion of the sealed part of the tube as disclosed in JP-B 1-23366, wherein it comprises two pairs of seal bars respectively disposed to oppose each other and a press for producing a sealing pressure between a pair of seal bars when they are positioned in a closing position where they approach each other.

The above-mentioned conventional press comprises a stationary engaging member which is disposed at both right and left sides of one of the paired seal bars and has an upward engaging recess and a movable engaging member which is disposed at both sides of the other of the paired seal bars and has a downward engaging protrusion engaging with the engaging recess of the stationary engaging member. The movable engaging member is secured to a piston rod of a hydraulic cylinder, and the piston rod is retreated in a state where the movable engaging member moves pivotally to engage with the stationary engaging member so that a sufficient sealing pressure of about 700 Kgf is produced between the seal bars.

The production of sealing pressure in the press owing to the retreat of the piston rod which is secured to the movable engaging member is performed by the oil under pressure of the hydraulic cylinder provided in the press, while the release of the sealing pressure and the advance of the piston rod is performed by the resilient force (about 30 Kgf) of a plurality of springs which are disposed coaxially in the cylinder and have different diameters at the same time when the hydraulic pressure is released, (e.g., see FIG. 12 of JP-B 1-23366). An idea to employ a biasing force other than the resilient force of the spring as a means for advancing the piston rod to which the movable engaging member is secured has not been hitherto considered in view of a space and cost of the lateral sealing apparatus having such a complex construction, and a need for such sealing apparatus has not been demanded so far. The springs provided in the hydraulic cylinder show durability as designed, and is sufficient to be replaced with another once a couple of months.

The inventors of the application have developed a superhigh-speed filling and packaging apparatus capable of manufacturing containers at a rate far in excess of 6000 pieces per hour which has been made so far, namely, more than 8000 pieces of containers per hour (as disclosed in Japanese Patent Application No. 8-244707). If the lateral sealing is performed at high speed using a conventional press in such a high-speed filling and packaging apparatus, it is newly found that since the hydraulic cylinder having springs therein is movable pivotally at higher speed than the conventional filling and packaging apparatus, there occur various problems such as breakage of springs for a short period of time and breakage of the engaging members at the portion where they engage with each other, which have not been considered in the press of the conventional filling and packaging apparatus.

When either of the springs provided inside the hydraulic cylinder, which is positioned at the back of the movable engaging member provided at both right and left sides of the seal bars, are broken, a piston rod which is retreated by hydraulic pressure in the hydraulic cylinder and to which the movable engaging member to which the sealing pressure is applied is not advanced although the sealing pressure is lost since the biasing force or the resiliency of the springs does not operate even if hydraulic pressure is not applied. In this case, since the sealing pressure is not applied to the movable and stationary sealing members which engage with each other, the movable and stationary sealing members disengage from each other owing to the upward pivotal motion of the piston rod. However, when the piston rod is moved downward pivotally for engaging the movable and stationary sealing members, the tip ends of the movable and stationary sealing members do not engage with each other once in several times depending on the situation, leading to a problem that the sealing pressure is not applied to the movable and stationary sealing members.

As a result, the press does not normally operate so that a package container in which incomplete lateral sealing is performed is manufactured, which causes a problem that a filler such as juice is leaked from the package container. If such leakage of the filler such as juice from the package container is visually recognized, it can be checked in a manufacturing process, but if such leakage is not visually recognized, it is very troublesome.

The reason is that in distribution channels of the germ-free filling and package container, such leakage of juice from the sealed parts causes a serious problem of propagation of the fungicide, etc. and contamination by a microorganism.

Since the springs are provided in the hydraulic cylinder, the damaging state of the springs cannot be seen from the outside. Even if either spring is damaged or broken during the manufacturing of the package container, the manufacture of the package container continues while either spring is damaged or broken, and hence there occurs a case that the damage or breakage of either spring is found out when the apparatus is checked upon completion of a day's manufacture so that all package containers manufactured at the same date must be scrapped. To avoid such a situation in advance, it is necessary to regularly replace either spring with another within a short period of time of about at least once a week anticipating safety, which incurs a troublesome labor to regularly replace either spring and also the increase of running cost involved in the replacement of either spring.

SUMMARY OF THE INVENTION

The present invention is to solve the problem of breakage of springs which occurred newly in the lateral sealing process employed by a high-speed filling and packaging apparatus and to provide a press capable of surely applying the pressure for a long period of time in the lateral sealing process employed by the high-speed filling and packaging apparatus.

The inventors have endeared themselves to study to solve the aforementioned problems and also to study a system of utilization of hydraulic pressure instead of springs, for avoiding other ascending and descending seal bars in the direction to advance the piston rod to which the engaging members are secured as a means for applying a biasing force, although such pipings become complex. And they found out a means capable of surely applying pressure for a long period of time in the lateral sealing process in the high-speed filling and packaging apparatus and of quickly detecting the inferior sealing, even if it occurs, and finally they completed this invention.

That is, the present invention relates to a press which comprises seal bars and a pair of engaging members which are respectively provided at both right and left ends of said seal bars for producing a sealing pressure when they engage with each other for permitting said seal bars to nip a packaging material web which is filled with a fluid content and formed in a tubular shape, wherein the press further comprises a means composed of a pressure of fluid such as air for applying a biasing force to at least one of the pair of engaging members in a direction to release engagement between the engaging members, namely, in the direction to advance the piston rod to which one of the engaging members is secured, and a pressure sensor capable of detecting change of pressure of fluid provided on a supply passage of fluid such as air.

Further, the present invention relates to the press comprising seal bars and a pair of engaging members which are respectively provided at both ends of said seal bars for producing a sealing pressure when they engage with each other for permitting said seal bars to nip a packaging material web which is filled with a fluid and formed in a tubular shape, wherein the press further comprises a first piston having a hole which directs toward a center and a radius thereof and communicates with the atmosphere, a second piston integrated with a piston rod, an air pressure chamber communicating with an air supply pipe, a hydraulic cylinder provided with a pressure chamber communicating with an oil supply pipe, and a pressure sensor provided on an air supply passage through which air is supplied to air pressure chamber through an air supply pipe for detecting change of pressure in the air supply passage, and wherein the engaging members comprise a movable engaging member which is secured to the piston rod and moves pivotally relative to one seal bar and a stationary engaging member which engages with the movable engaging member and is fixed to another seal bar. The present invention also relates to a filling and packaging apparatus provided with the aforementioned press, particularly to a high-speed filling and packaging apparatus capable of manufacturing 8,000 pieces of package containers or more per hour.

PREFERRED EMBODIMENT OF THE INVENTION

A press according to a preferred embodiment will be now described with reference to the attached drawings. However, the present invention is not limited to the embodiment set forth hereunder and drawings.

Figure 1:
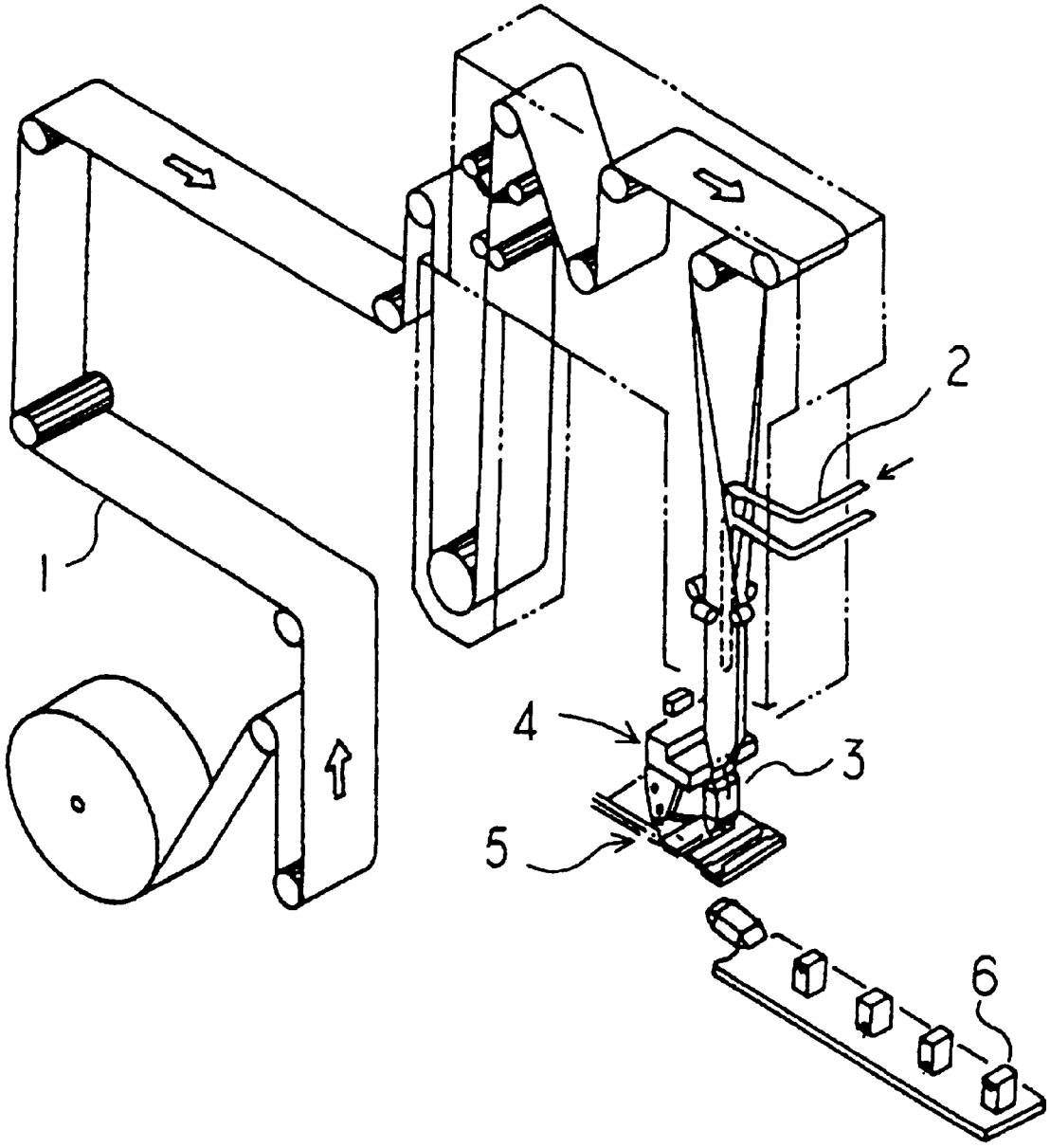
FIG. 1 is a schematic perspective view of a high-speed filling and packaging apparatus.

A filling and packaging apparatus for which the press of the invention is particularly adapted comprises, as shown in FIG. 1, a rewinder for supporting a packaging material web 1 in a rolled state, a winding apparatus for winding the web in order from the rewinder, a tube-forming apparatus for forming the wound web in a tubular shape after sterilizing it, a liquid supply pipe 2 for filling a fluid content in the packaging material web which was formed in the tubular shape, and a lateral sealing apparatus 4 for laterally sealing the web and cutting sealed parts of the web to continuously form pillow-like containers 3 while downwardly supplying the tube filled with the fluid by the length corresponding to one container, a cutting apparatus 5 which is provided under the lateral sealing apparatus and cuts the sealed part of the hanging pillow-like container for cutting the container one by one, and a container shaping apparatus for bending the end parts of each separated pillow-like container 3 to shape each pillow-like container in a parallelepiped container 6 to be finally obtained.

As the lateral sealing apparatus 4, it is possible to use the apparatus as disclosed in the aforementioned JP-B 1-23366. And as shown in FIG. 2, it comprises vertical rods 10 which are movable upward and downward and also turn reversibly, movable frames 11 which move upward and downward together with the vertical rods 10 and are secured to the vertical rods 10, a pair of front and back swing arm arms 12 and 13 which are respectively supported by the movable frames 11 so as to move pivotally about a pair of horizontal axes which are in parallel with each other thereunder, a pair of front and back seal bars 14 and 15 which are respectively secured to and oppose each other over the swing arms 12 and 13, an arm-closing device 16 for moving the swing arms 12 and 13 pivotally between a closing position where the seal bars 14 and 15 approach to each other and an opening position where the seal bars 14 and 15 move away from each other, and a press 20 provided on the seal bars 14 and 15 at right and left thereof for pulling the swing arms 12 and 13 against each other in the closing position to produce the sealing pressure between the seal bars 14 and 15.

Two movable frames 11 synchronously move upward and downward alternately in a different direction with a given stroke. That is, when one movable frame 11 moves upward, the other movable frame 11 moves downward. When the movable frame 11 is located at the upper limit position of the ascending stroke, the seal bars 14 and 15 mutually close so that a tube 7 is forcibly pressed and sealed with a prescribed width in lateral sectional shape. When the seal bars 14 and 15 move downward together with the movable frame 11 while they press the tube 7, the tube 7 is fed by the length corresponding to one container. When the movable frame 11 reaches the lower limit position, the seal bars 14 and 15 open to release the tube 7.

Next, the press 20 will be now described more in detail with reference to FIGS. 2 to 5.

Figure 2:
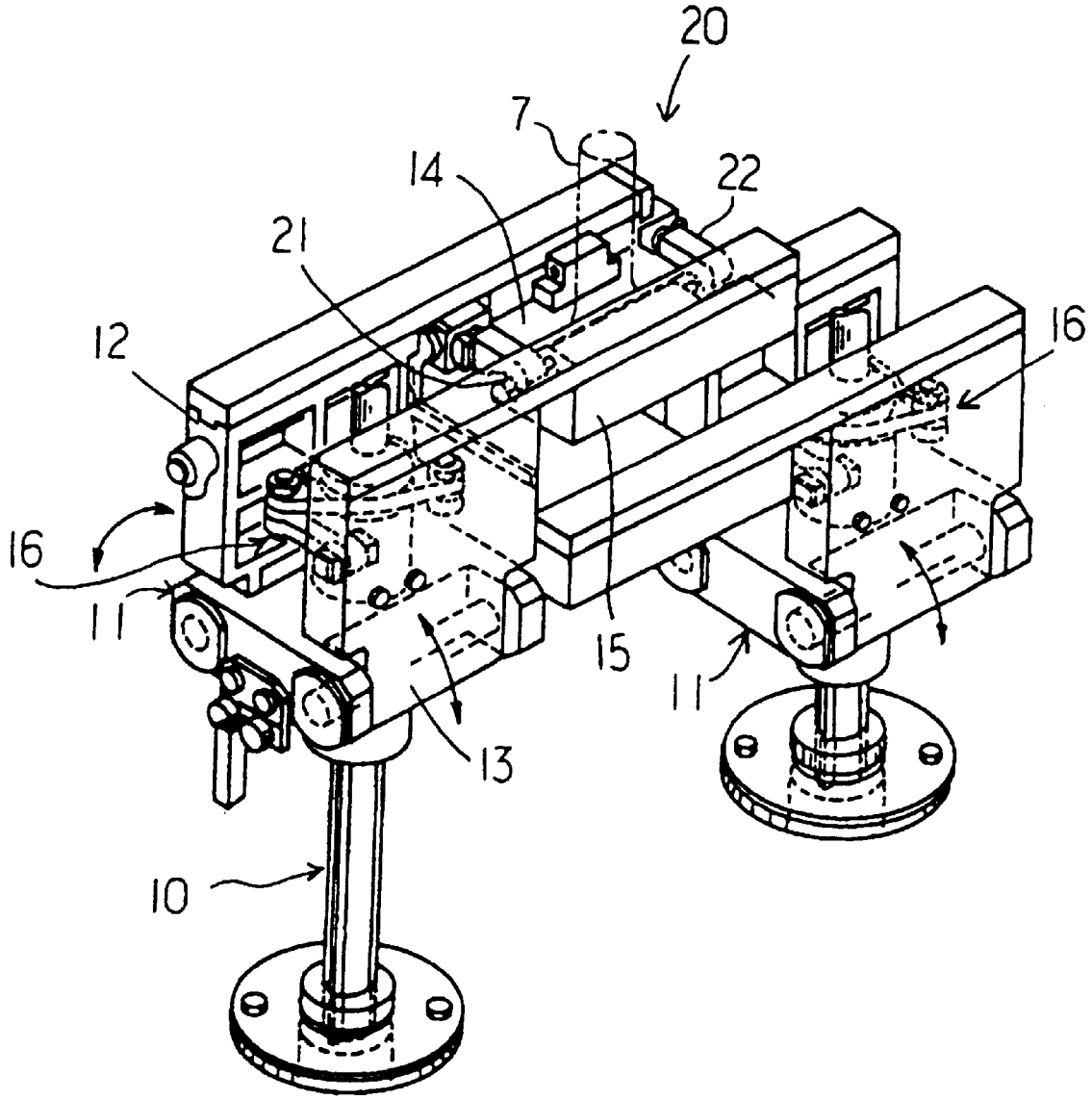
FIG. 2 is a perspective view of a lateral sealing apparatus.
Figure 3:
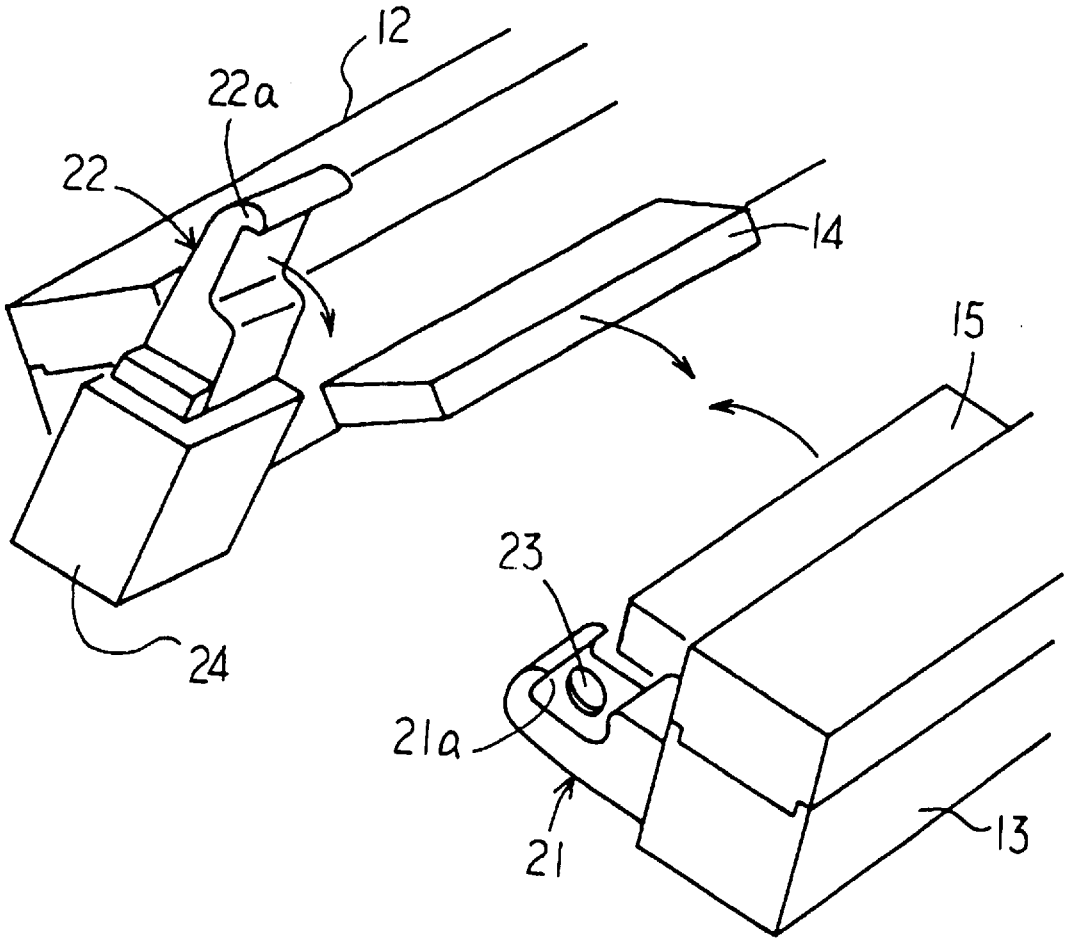
FIG. 3 is a schematic perspective view of a press of the present invention.

As shown in FIGS. 2 and 3, the press 20 comprises a pair of right and left stationary engaging members 21 which are respectively integrally formed with the seal bar 15 of the swing arm 13 at both sides thereof and each having an upward engaging recess 21*a*, and movable engaging members 22 which are respectively integrally formed with the seal bar 14 of the swing arm 12 at both sides thereof and each having a downward engaging protrusion 22*a* which engages with the engaging recess 21*a* of the stationary engaging member 21. As shown in FIG. 3, a buffer material 23 may be provided on the stationary engaging member 21 at the portion where the tip end of the movable engaging member 22 contacts the stationary engaging member 21 by the pivotal motion of the movable engaging member 22.

Figure 4:
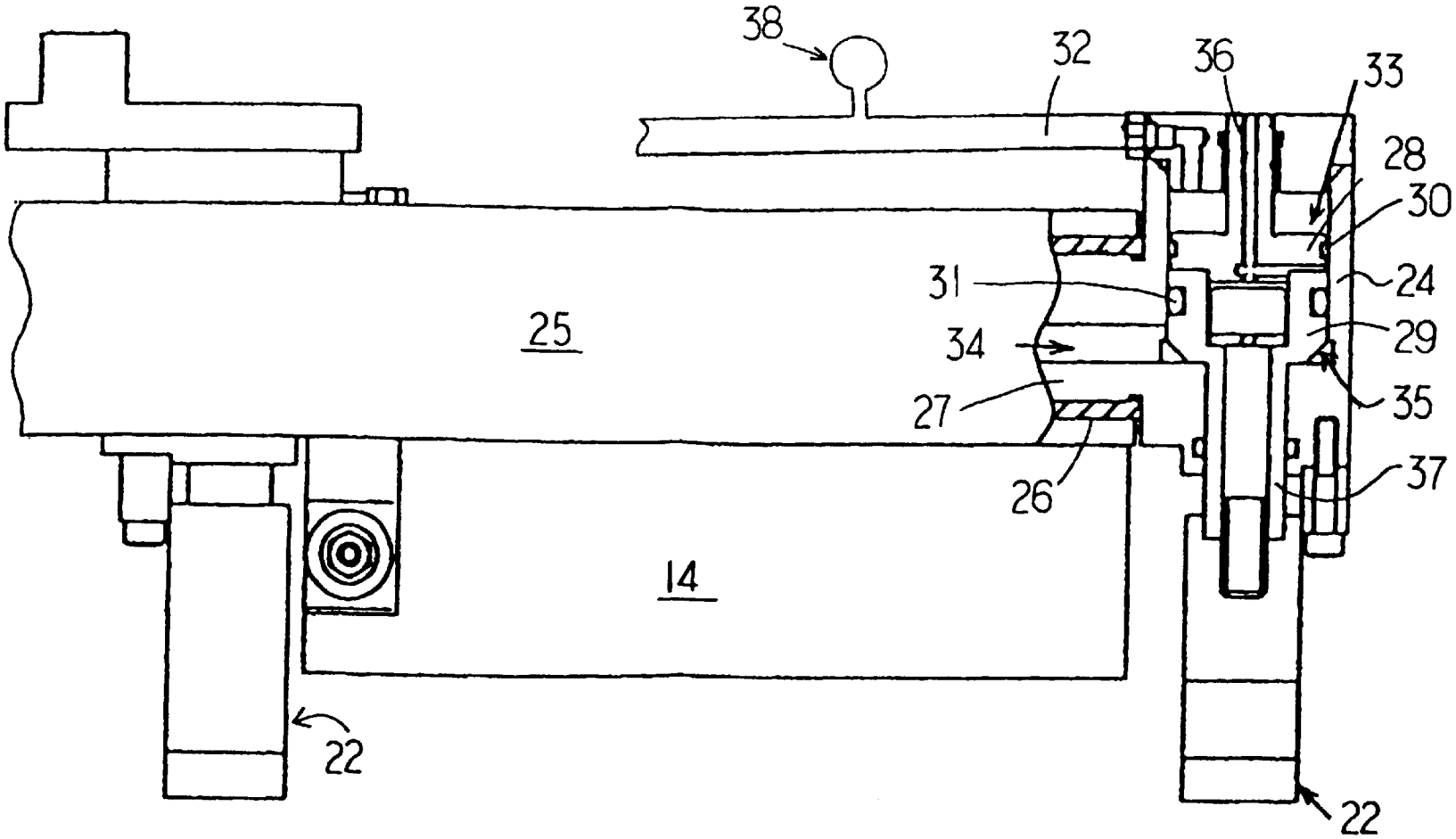
FIG. 4 is a partially sectional plan view of the press of the present invention.
Figure 5:
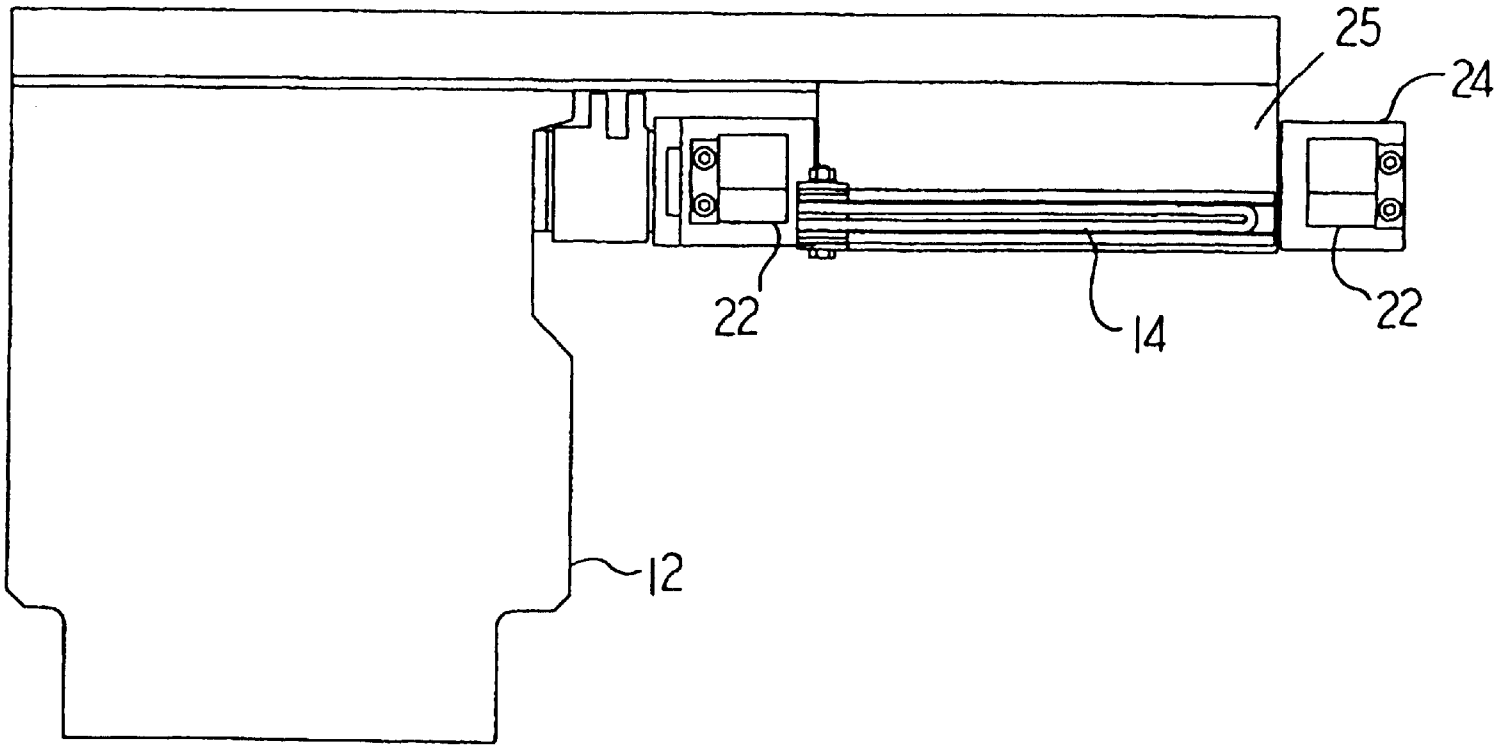
FIG. 5 is a longitudinal sectional front view of the press of the present invention.

As shown in FIG. 4, the press 20 has hydraulic cylinders 24, and the hydraulic cylinders 24 are integrally provided at both ends of a horizontal rotary shaft 27 which penetrates a prismatic block 25 of the swing arm 12 and is provided in the block 25, and which is rotatably supported via a pair of bushes 26.

Two pistons 28 and 29 are incorporated inside the hydraulic cylinders 24. O rings 30 and 31 are mounted in grooves defined in outer peripheries of these pistons to prevent leakage of air supplied to the air pressure chamber 33 through an air supply pipe 32 and oil supplied to an oil pressure chamber 35 through an oil supply pipe 34.

A communication hole 36 is bored in the piston 28 which bore directs toward the center and radius thereof. Even if air leaks from the O ring 30, it is discharged outside through the communication hole 36 defined in the piston 28, but not mixed in the oil pressure chamber 35. A piston rod 37 is integrally provided with the piston 29 and the movable engaging member 22 is secured to the piston rod 37 as shown in FIG. 4.

Air is always supplied to the air pressure chamber 33 communicating with the air supply pipe 32 so as to always apply the biasing force in a direction to permit the piston rod 37 to be in an advancing position, namely, in a direction to advance (protrude) the piston rod to release the engagement between the engaging members. Oil is supplied to the oil pressure camber 35 communicating with the oil supply pipe 34 when the engaging members 21 and 22 engage with each other so as to retreat the piston rod against the biasing force to produce the sealing pressure, while when the engaging members 21 and 22 disengage from each other, the supply of oil from the oil supply pipe 34 is stopped, thereby reducing the hydraulic pressure inside the oil pressure chamber 35 to zero.

A pressure sensor 38 capable of detecting the change of pressure in an air supply passage leading to the air supply pipe 32 is secured to the air supply passage. The pressure sensor 38 always monitors the change of pressure and the filling and packaging apparatus is stopped when it detects a malfunction of pipes when they come off. On the other hand, the oil supply pipe 34 penetrates the horizontal rotary shaft 27 in the axial direction thereof and communicates with the oil pressure chamber 35 of each hydraulic cylinder 24, and is connected with an operation oil pipe, not shown.

The lateral sealing process is described next. When the swing arms 12 and 13 pivotally move from the opening position to the closing position, the movable engaging member 22 remains in the forward upward inclined position from the state where it crosses at right angles with the swing arms 12 and 13. When the swing arms 12 and 13 reach the portion close to the closing position, the movable engaging member 22 turns together with the hydraulic cylinder 24 and changes its position from the upward inclined position to a horizontal position, and the tip end thereof engages with the stationary engaging member 21.

When the piston rod 37 is retreated from the hydraulic cylinder 24 by the supply of oil serving as the working fluid from the oil supply pipe 34 to the oil pressure chamber 35 of the hydraulic cylinder 24, the movable engaging member 22 moves together with the piston rod 37 so that the stationary engaging member 21 and movable engaging member 22 engage with each other to pull against each other. As a result, the seal bars 14 and 15 on which the stationary engaging member 21 and movable engaging member 22 are fixedly mounted are also pulled against each other, thereby producing a sealing pressure between the seal bars so that the tube 7 is pressurized and heated to complete the lateral sealing.

When the supply of the oil serving as working fluid from the oil pressure chamber 35 through the oil supply pipe 34 is stopped to reduce the hydraulic pressure to zero before the swing arms 12 and 13 move pivotally from the closing position to the opening position, the engagement between the stationary engaging member 21 and movable engaging member 22 is released so that the movable engaging member 22 is changed in position by springs, not shown, from the state where it crosses at right angles with the swing arm 12 to the state where it is inclined forward upward since air is always supplied to the air pressure chamber 33 through the air supply pipe 32 to permit the biasing force to operate always for advancing the piston rod 37 via the pistons 28 and 29. Thereafter the similar operations are repeated.

Although two pistons 28 and 29 are provided in the hydraulic cylinder 24 to advance or retreat the piston rod 37 according to the preferred embodiment, the piston rods 28 and 29 may be integrated with each other to advance or retreat the piston rod 37 as a single piston.

Although air is employed as pressure medium for always applying the biasing force in the direction where the piston rod is advanced in the preferred embodiment, other pressure mediums such as oil and water may be used instead of air.

According to the present invention, since hydraulic pressure is utilized instead of springs as a means for applying the biasing force in the direction where the piston rod to which the movable engaging member is secured is advanced in the complex press of this type, the pressure application in the lateral sealing process can be surely performed for a long period of time in a high-speed filling and packaging apparatus capable of manufacturing the 8000 pieces of package containers or more per hour as well as in the conventional filling and packaging apparatus. As a result, the troublesome operation such as replacement of springs can be omitted and running cost involved in purchasing new springs can be omitted compared with the conventional case using the springs.

Since any spring has a spring constant which is not constant during the operation thereof, and a filling and packaging apparatus of this type requires a large sealing pressure, the spring constant is inevitably made large and the amount of change of the sealing pressure is made large. However, if the hydraulic pressure is utilized like the case of the present invention, the piston rod is advanced and retreated smoothly so that the sealing pressure is not changed every time the sealing is performed, thereby stabilizing the sealing surfaces of the seal bars.

Further, although the sealing pressures at the right and left of the seal bars have not been made uniform when using springs in the press of this type for operating the sealing pressure by a pair of right and left seal bars, the sealing pressures at the right and left of the seal bars are not dispersed to accomplish the uniform lateral sealing since the air pressure chambers of the right and left hydraulic cylinders communicate with each other by the employment of the fluid or hydraulic pressure like this invention.

Still further, since the pressure sensor for always monitoring the change of pressure is provided on the air supply passage according to the present invention, it can detect instantaneously the malfunction of pipes when they come off if such malfunction occurs, thereby stopping the operation of the filling and packaging apparatus immediately to minimize the occurrence of production of an inferiorly sealed product.

What is claimed is:

1. A press comprising:

seal bars, a pair of engaging members provided at both right and left ends of each said seal bar for producing a sealing pressure when said seal bars engage with each other whereby said seal bars nip a packaging material web which is filled with a fluid and formed to have a tubular shape, and means for applying a biasing force to release engagement between said engaging members, said biasing force of said applying means being applied due to fluid pressure, and being applied in a direction of release of engagement between said engaging members.

2. The press according to claim 1, wherein said fluid is air.

3. The press according to claim 1, wherein a pressure sensor for detecting fluid pressure change is provided with a fluid supply passage.

4. The press according to claim 1, wherein said pair of engaging members comprises a movable engaging member which is movable pivotally relative to its respective seal bar and a stationary engaging member which is fixed to said seal bar.

5. A filling and packaging apparatus provided with the press as set forth in claim 1.

6. A press comprising seal bars and a pair of engaging members which are respectively provided at both right and left ends of said seal bars for producing a sealing pressure when they engage with each other for permitting said seal bars to nip a packaging material web which is filled with a fluid and formed in a tubular shape, said press further comprising a first piston having a hole which directs toward a center and a radius thereof and communicates with the atmosphere, a second piston integrated with a piston rod, a hydraulic cylinder provided with a pressure chamber communicating with an oil supply pipe, and a pressure sensor provided on an air supply passage through which air is supplied to an air pressure chamber through an air supply pipe for detecting a change in pressure in the air supply passage, and wherein the engaging members comprise a movable engaging member which is secured to the piston rod and movable pivotally relative to the seal bar and a stationary engaging member which engages with the movable engaging member and is fixed to the seal bar.

* * * * *